US005922669A

United States Patent [19]

Quebedeaux et al.

[11] Patent Number: 5,922,669

[45] Date of Patent: Jul. 13, 1999

[54] NO-RUB HARD SURFACE CLEANER COMPRISING AN ALCOHOL ETHOXYLATE-AMINE OXIDE SURFACTANT MIXTURE AND A NITROGENOUS BUILDER IN AQUEOUS SOLUTION

[75] Inventors: Deborah A. Quebedeaux, Thibodaux; Conrad J. Langlois, Jr., New Roads; Joe D. Sauer; Patrick C. Hu, both of Baton Rouge, all of La.

[73] Assignee: Albemarle Corporation, Richmond, Va.

[21] Appl. No.: 08/927,708

[22] Filed: Sep. 10, 1997

[51] Int. Cl.[6] ..... C11D 1/75; C11D 1/72; C11D 3/30

[52] U.S. Cl. ..... 510/421; 510/235; 510/237; 510/238; 510/289; 510/333; 510/362; 510/363; 510/361; 510/356; 510/398; 510/413; 510/434; 510/477; 510/480; 510/503; 510/423

[58] Field of Search ..... 510/235, 237, 510/238, 289, 333, 362, 363, 361, 356, 398, 413, 434, 477, 480, 503, 421, 423

[56] References Cited

U.S. PATENT DOCUMENTS

| | | | |
|---|---|---|---|
| 3,963,649 | 6/1976 | Spadini et al. | 252/546 |
| 4,276,205 | 6/1981 | Ferry | 252/528 |
| 4,405,483 | 9/1983 | Kuzel et al. | 252/140 |
| 4,436,653 | 3/1984 | Jacobson et al. | 252/547 |
| 4,537,706 | 8/1985 | Severson, Jr. | 252/545 |
| 5,522,942 | 6/1996 | Graubart et al. | 134/40 |

*Primary Examiner*—Mark Kopec
*Assistant Examiner*—Charles Boyer
*Attorney, Agent, or Firm*—Philip M. Pippenger

[57] ABSTRACT

Improved results are obtained in the no-rub cleaning of hard surfaces when the cleaner used in the process is an aqueous solution of (A) about 40–50% by weight of a nonionic surfactant mixture of an alcohol ethoxylate and a $C_{8-16}$ alkyldimethylamine oxide in a weight ratio of about 5–15/1 and (B) correspondingly, about 60–50% by weight of one or more nitrogenous builders.

9 Claims, No Drawings

NO-RUB HARD SURFACE CLEANER COMPRISING AN ALCOHOL ETHOXYLATE-AMINE OXIDE SURFACTANT MIXTURE AND A NITROGENOUS BUILDER IN AQUEOUS SOLUTION

FIELD OF INVENTION

This invention relates to a novel hard surface cleaner and more particularly to such a cleaner which does not have to be rubbed onto the surface to be cleaned in order to give satisfactory performance.

BACKGROUND

There are several known surfactant-containing formulations which are satisfactory for cleaning hard surfaces that can be easily rubbed with a cleaning formulation to loosen the oil, grease, particulates, or other soils before they are rinsed. However, many hard surfaces (e.g., those of aircraft, trucks, trailers, dwellings, and other large structures) present a particularly difficult cleaning challenge because of having large surfaces, complex shapes and contours, and/or relatively inaccessible areas which make it at least very difficult to provide adequate coverage of their dirty areas with a cleaner which must be rubbed onto those areas during or after application of the cleaner. When attempts have been made to clean such surfaces by spraying them with conventional hard surface cleaners and then rinsing and air-drying them without any intermediate rubbing step, it has been found that successful performance (i.e., provision of a clean, streak-free, and spot-free surface after air-drying) was not achieved with cleaners known to be satisfactory for cleaning hard surfaces when rubbed onto them during the cleaning process. Thus, there is a need for a satisfactory no-rub hard surface cleaner, i.e., a hard surface cleaner which provides successful cleaning performance when applied to a hard surface and then rinsed therefrom without any use of rubbing.

SUMMARY OF INVENTION

It has now been found that satisfactory cleaning performance can be achieved in a no-rub cleaning of hard surfaces when the no-rub hard surface cleaner is an aqueous solution of (A) about 40–50% by weight of a nonionic surfactant mixture of an alcohol ethoxylate and a $C_{8-16}$ alkyldirnethylamine oxide in a weight ratio of about 5–15/1 and (B) correspondingly, about 60–50% by weight of one or more nitrogenous builders.

DETAILED DESCRIPTION

The alcohol ethoxylate employed in the practice of the invention may be one or more compounds corresponding to the formula $Z(OCH_2CH_2)_nOH$ in which Z is an alkyl group containing 8–16 carbons and n is an integer of 2–15, preferably 5–8, such that the ethoxylate has an HLB number of at least 12. Particularly preferred alcohol ethoxylates are apt to be (1) the ethoxylate of dodecanol in which n is 6, (2) the ethoxylate of a mixture of $C_{10}$ and $C_{12}$ alcohols in which n is 6, (3) the ethoxylate of a mixture of $C_{12}$ and $C_{14}$ alcohols in which n is 6, and (4) the ethoxylate of a mixture of $C_{12}$ and $C_{14}$ alcohols in which n is 3 —the ethoxylate of a mixture of $C_{10}$ and $C_{12}$ alcohols in which n is 6 usually being most preferred. However, other ethoxylates corresponding to the above formula, especially other 5-EO, 6-EO, 7-ED, and 8-ED ethoxylates formed from octanol, decanol, dodecanol, tetradecanol, pentadecanol, hexadecanol, and mixtures thereof, are also utilizable.

The amine oxide used as a component of the surfactant includes at least one $C_{8-16}$ alkyldimethylamine oxide, such as N-octyl-, N-decyl-, N-dodecyl-, N-tetradecyl-, or N-hexadecyldimethylamine oxide.

As already mentioned, the alcohol ethoxylate and amine oxide are combined in a weight ratio of about 5–15/1. There can be a cost advantage to the use of the higher ratios within this range, but ratios in the range of about 5–10/1 are frequently preferred to provide optimum cleaning performance.

The nitrogenous builders which may be used as components of the no-rub hard surface cleaners are materials already known to be utilizable as builders in other detergent compositions; and the builders preferred for use in the present invention are those which are best known, i.e., the alkali metal (usually sodium) and ammonium salts of ethylenediaminetetraacetic acid, diethylenetriaminepentaacetic acid, triethylenetetraminehexaacetic acid, and nitrilotriacetic acid. In a preferred embodiment of the invention, the nitrogenous builder is a mixture of ethylenediamineaminotetraacetic acid and nitrilotriacetic acid builders in a weight ratio of about 0.5–2/1, more preferably about 1.0–1.5/1.

When actually used in a no-rub cleaning process, the hard surface cleaners of the invention are sprayed onto the surface to be cleaned and therefore should contain an amount of water sufficient not only to dissolve the aforementioned active ingredients but also to provide compositions in which the solids content is high enough to ensure adequate cleaning but low enough for the compositions to be sprayable and economical —usually a solids content of at least about 0.15% by weight, most commonly about 0.15–5% by weight. However, since (1) the optimum solids content for this purpose can vary considerably in different cleaning operations because of factors such as different types of soils to be removed from a surface and (2) shipping costs are increased when the amount of water in the compositions is more than the amount required to dissolve the active ingredients, it is sometimes preferred to prepare the cleaning compositions as concentrated aqueous solutions, e.g. solutions having solids contents of about 10–20% by weight, and then ship them to customers who can dilute them to the desired degree.

If desired, the formulations may also contain minor amounts of optional ingredients (e. g., quaternary ammonium compounds such as N-dodecyl-N-tetradecyl-N,N-dimethylammonium bromide, defoamers such as silicones, and corrosion inhibitors such as free amines) which, when employed, are incorporated in amounts such that they constitute less than 50%, ordinarily about 0–5% of the total solids weight.

The invention is advantageous in that the novel no-rub cleaners make it possible to clean a hard surface by a no-rub process in which a soiled hard surface is sprayed with the novel cleaner and then rinsed and allowed to dry to a clean, streak-free, and spot-free surface. Because they do not have to be rubbed onto dirty areas during or after their application to the surfaces to be cleaned, the novel cleaners are especially advantageous for the cleaning of hard surfaces, such as those of aircraft, trucks, trailers, dwellings, and other structures which have large surfaces, complex shapes and contours, and/or relatively inaccessible areas that are particularly difficult to clean satisfactorily with conventional hard surface cleaners.

The following examples are given to illustrate the invention and are not intended as a limitation thereof. Unless otherwise specified, quantities mentioned in the examples are quantities by weight. Codes used in the examples have the meanings given below.

| Code | Definition |
|---|---|
| AX-8 | N-octyldimethylamine oxide |
| AX-14 | N-tetradecyldimethylamine oxide |
| C610-3EO | 3-EO ethoxylate of a mixture of hexanol, octanol, and decanol |
| C1012-6EO | 6-EO ethoxylate of a mixture of decanol and dodecanol |
| C12-6EO | 6-EO ethoxylate of dodecanol |
| C1214-6.5EO | 6.5-EO ethoxylate of a mixture of dodecanol and tetradecanol |
| LAS | sodium salt of linear $C_{10-15}$ alkylbenzene sulfonate |
| EDTA | tetrasodium ethylenediaminetetraacetate dihydrate |
| NTA | trisodium nitrilotriacetate monohydrate |
| DADMAB-1214 | N-dodecyl-N-tetradecyl-N,N-dimethylammonium bromide |

EXAMPLE 1

Prepare a cleaning formulation by dissolving 0.3 part of AX-14, 2.7 parts of C12-6EO, 2.4 parts of EDTA, and 1.7 part of NTA in 42.9 parts of water to form a concentrate. Then dilute the formulation with 20 times its weight of water, spray the diluted formulation on dirty glass panels, rinse the sprayed panels with water, allow the panels to dry, and inspect the treated panels for cleanliness. The panels are clean and free of streaks and spots.

EXAMPLES 2–7

Repeat Example 1 in the preparation and testing of six cleaning formulations except for varying the ingredients and proportions in the concentrates and then compare the cleaniness of the panels treated with the different formulations, assigning values from 1–5-1 being worst and 5 being best. The compositions of the different concentrates and the rankings of the treated panels are shown in the table below.

TABLE

| Example | 2 | 3* | 4 | 5* | 6* | 7* |
|---|---|---|---|---|---|---|
| AX-8 | — | — | 0.3 | — | — | — |
| AX-14 | 0.3 | — | — | 0.18 | 0.3 | 0.3 |
| C610-3EO | — | — | — | — | 2.7 | — |
| C1012-6EO | 2.7 | 2.7 | 2.7 | 2.2 | — | — |
| C1214-6.5EO | — | — | — | — | — | 2.7 |
| LAS | — | — | — | 1.8 | — | — |
| EDTA | 2.4 | — | 2.4 | — | 2.4 | 2.4 |
| NTA | 1.7 | — | 1.7 | — | 1.7 | 1.7 |
| Citric acid | — | — | — | 3.0 | — | — |

TABLE-continued

| Example | 2 | 3* | 4 | 5* | 6* | 7* |
|---|---|---|---|---|---|---|
| Na silicate | — | 4.0 | — | — | — | — |
| DADMAB-1214 | — | 0.1 | 0.1 | — | — | — |
| Water | 42.9 | 42.9 | 42.9 | 42.9 | 42.9 | 42.9 |
| Soil removal | 4 | 4 | 4 | 1 | 3 | 3 |
| Streaking | 4 | 4 | 4 | 1 | 2 | 2 |
| Spotting | 4 | 1 | 4 | 1 | 2 | 2 |

*Comparative Example

Similar results are observed when the preceding examples are repeated except that the concentrates are diluted with 30, 40, or 90 times their weight of water.

What is claimed is:

1. A no-rub hard surface cleaner which comprises an aqueous solution of (A) about 40–50 parts by weight of a nonionic surfactant mixture of an alcohol ethoxylate and a $C_{8-6}$ alkyldimethylamine oxide in a weight ratio of about 5:1 to about 15:1 and (B) correspondingly, about 60–50 parts by weight of one or more nitrogenous builders in an amount of water such as to provide a solids content of at least about 0.15% by weight; said nonionic surfactant mixture and nitrogenous builder constituting at least about 95% of the total weight of solids in the solution.

2. The process of claim 1 wherein the alcohol ethoxylate is a compound corresponding to the formula $Z(OCCH_2CH_2)_nOH$ in which Z is an alkyl group containing 8–16 carbons and n is an integer of 2–15 such that the ethoxylate has an HLB number of at least 12.

3. The process of claim 2 wherein n is an integer of 5–8.

4. The process of claim 3 wherein the alcohol ethoxylate is a 6-EO ethoxylate of dodecanol.

5. The process of claim 3 wherein the alcohol ethoxylate is a 6-EC ethoxylate of a mixture of decanol and dodecanol.

6. The process of claim 1 wherein the amine oxide is N-tetradecyldimethylamine oxide.

7. The cleaner of claim 1 wherein the nitrogenous builder is selected from the group consisting of the alkali metal and ammonium salts of ethylenediaminetetraacetic acid, diethylenetriaminepentaacetic acid, triethylenetetraminehexaacetic acid, and nitrilotriacetic acid.

8. The cleaner of claim 1 wherein the nitrogenous builder is a mixture of ethylenediamineaminotetraacetic acid and nitrilotriacetic acid builders in a weight ratio of about 0.5:1 to about 2:1.

9. The process of claim 8 wherein the ethylenediamineaminotetraacetic acid/nitrilotriacetic acid builder weight ratio is about 1.1to about 1.5:1.

* * * * *